United States Patent [19]

Ohta

[11] 4,019,342

[45] Apr. 26, 1977

[54] COMPRESSOR FOR A REFRIGERANT GAS

[75] Inventor: Motomu Ohta, Sakashi, Japan

[73] Assignee: Cegedur Societe de Transformation de l'Aluminium Pechiney, Paris, France

[22] Filed: Jan. 30, 1976

[21] Appl. No.: 654,007

[30] Foreign Application Priority Data

Mar. 13, 1975 Japan ..... 50-30969

[52] U.S. Cl. ..... 62/469; 417/372

[51] Int. Cl.[2] ..... F25B 43/02; F04B 17/00; F04B 35/00; F04B 39/02

[58] Field of Search ..... 62/468, 469, 470; 417/372; 418/83

[56] References Cited

UNITED STATES PATENTS

| | | | |
|---|---|---|---|
| 1,981,606 | 11/1934 | Stock | 62/468 |
| 2,031,080 | 2/1936 | Deventer | 62/469 |
| 2,285,754 | 6/1942 | Money | 417/372 |
| 2,809,872 | 10/1957 | Warner | 417/372 |
| 3,133,429 | 5/1964 | Griffin | 62/469 |
| 3,229,901 | 1/1966 | Parker | 417/372 |

*Primary Examiner*—Lloyd L. King
*Attorney, Agent, or Firm*—McDougall, Hersh & Scott

[57] ABSTRACT

A compressor for a refrigerant gas wherein a rotor acts on a rocking plate to effect rocking thereof and reciprocation of pistons in cylinder bores to produce suction and exhaust strokes for refrigerant gas. A lubricant is contained in a sump in the compressor casing and it is atomized and mixed with refrigerant gas which leaks past the pistons. A duct is formed in the casing for conveying the mixture of refrigerant gas and lubricant from the casing under the action of the suction stroke of the pistons. The mixture is delivered at the inlet for refrigerant gas and the total mixture now flows to a separator where the lubricant is separated from the refrigerant gas. The refrigerant gas is then supplied into the cylinder bores during the suction stroke and the lubricant is delivered into a reservoir where it is forceably delivered back into the casing to the sump.

9 Claims, 4 Drawing Figures

COMPRESSOR FOR A REFRIGERANT GAS

FIELD OF THE INVENTION

The present invention relates to compressors used in air conditioning units of vehicles and the like, such as motor cars.

BACKGROUND

In compressors of such type any refrigerant gas leaking around the peripheral surface of the reciprocating pistons flows into the rotor chamber and causes the pressure within the rotor chamber to increase. Conventionally the leaked refrigerant gas in the rotor chamber is returned to the suction side. Lubricating oil contained in a sump within the rotor chamber is stirred and atomized to lubricate all portions of the bearings and lubricating oil flows to the suction side together with the leaked refrigerant gas and is returned again into the rotor chamber. A disadvantage arises in that a large amount of lubricating oil is introduced into the refrigerating machine during the exhaust strokes and degrades the refrigerating capability while the temperature within the rotor chamber gradually increases and causes lowering of the lubricating capability.

Furthermore, as the pressure within the rotor chamber increases due to the leaked refrigerant gas, it is difficult to smoothly return the lubricating oil being introduced into the suction side again to the rotor chamber, and thereby a large amount of lubricating oil is contained at all times in the refrigerating cycle, whereby the refrigerating capability is considerably lowered.

SUMMARY OF THE INVENTION

An object of the present invention is to provide a compressor for a refrigerant gas which avoids the above-noted disadvantages.

According to the invention, lubricating oil flowing with leaked refrigerant gas is separated from said gas by a separator means and is deposited into an oil reservoir provided at the suction side and the lubricating oil is forcedly delivered from the reservoir in positive fashion back into the rotor chamber by an oil delivery means disposed at the end of the rotor driving shaft and communicating with said oil reservoir.

BRIEF DESCRIPTION OF THE DRAWING

The attached drawing shows one embodiment according to the present invention, and therein.

DETAILED DESCRIPTION

Figure 1:
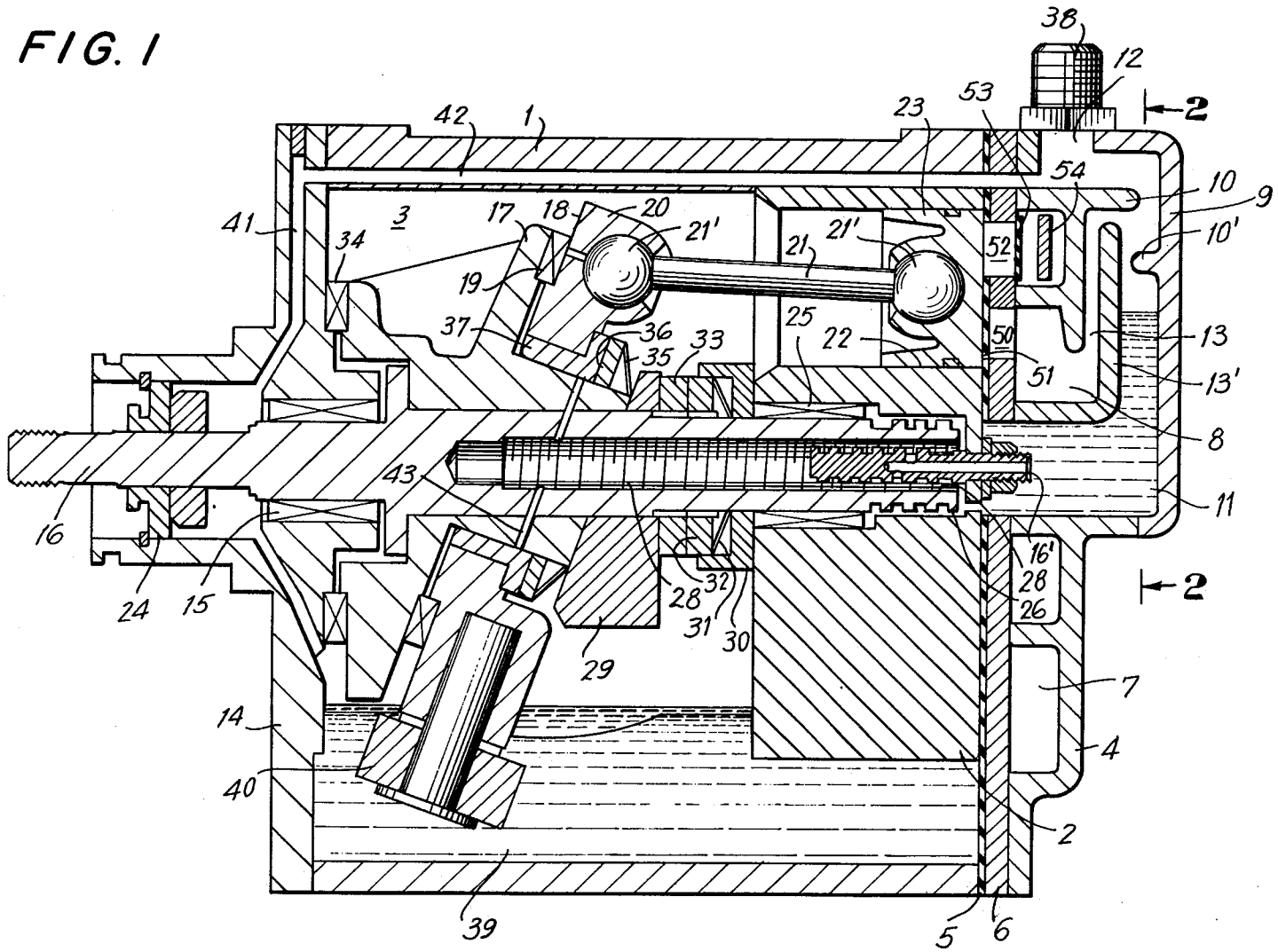
FIG. 1 is a longitudinal cross-section taken through the compressor according to the invention, the piston being in the position just before the starting of the suction stroke.

Referring to the drawing, therein is shown a compressor for a refrigerant unit comprising a casing 1 in which a cylinder block 2 is fitted at one end thereof while a rotor chamber 3 is formed at the other end thereof. A cylinder head 4 is fixed to that end of the casing receiving the cylinder block 2 and a valve seat 5 and valve plate 6 are clamped between the cylinder head 4 and the casing 1 and block 2. The head 4 is formed with an exhaust chamber 7 at the periphery thereof and a suction chamber 8 centrally thereof. An oil separating chamber 9 is fixed at the exterior of the cylinder head 4 and is formed with an oil reservoir 11 and baffle separators 10 and 10' thereabove. A suction port 12 for inlet of a refrigerant gas is formed at the upper end of the oil separating chamber 9 and port 12 communicates with suction chamber 8 through a vent chamber 13 provided between cylinder head 4 and a vertical partitioning element 13' integrally projecting from the exterior wall of the cylinder head 4.

A cover body 14 is fixed to the other end of the casing 1 and is provided with bearings 15 for a rotor driving shaft 16. A rotor body 17 is fixed to the rotor driving shaft 16 within the rotor chamber 3 and bears against inclined rocking plate 20 at inclined surface 18 thereof through bearings 19 to rock the inclined rocking plate by the rotation of the rotor body 17. The inclined rocking plate 20 is connected by means of connecting rods 21 and universal joints 21' with pistons 23 slidably fitted in a plurality of cylinder bores 22 in cylinder block 2.

A mechanical seal 24 is provided at that portion where one end of the rotor shaft 16 passes through the cover body 14. The other end of the rotor shaft 16 is supported by the cylinder block 2 through bearing 25 and communicates with oil reservoir 11. A male screw thread 26 is formed on the external surface of rotor shaft 16 and a threaded bore 28 is formed in shaft 16 for a purpose to be explained later. A center screw 16' is secured to block 2 and loosely engages in bore 28 also for a purpose to be explained later.

An axial pressure plate 29 is mounted on rotor shaft 16 and acts to urge the rotor body 17 against bearings 34 on cover body 14 to prevent axial movement of the rotor body 17. The pressure plate 29 is axially biased by means of an assembly disposed between plate 29 and cylinder block 2 and comprising a seating plate 30, a plate spring 31 and thrust plates 32, 33. The plate 29 applies pressure against the inclined rocking plate 20 through plate spring 35, thrust plate 36 and bushing 37.

Numeral 38 designates a suction nipple for the inlet of refrigerant gas and numeral 39 designates an oil sump at the bottom of the rotor chamber 3. A trunnion block 40 is attached to the lower end of the inclined rocking plate 20 to ride in a track or slideway in casing 1 to prevent rotation of the rocking plate 20.

The bushing 37 undergoes high speed rotation while riding on rocking plate 20 while trunnion block 40 travels at high speed on the fixed track or slideway in casing 1. In order to make the bushing 37 and the trunnion block 40 lightweight with maximum wear characteristics, they are made of aluminum alloy with 20% Si.

Figure 2:
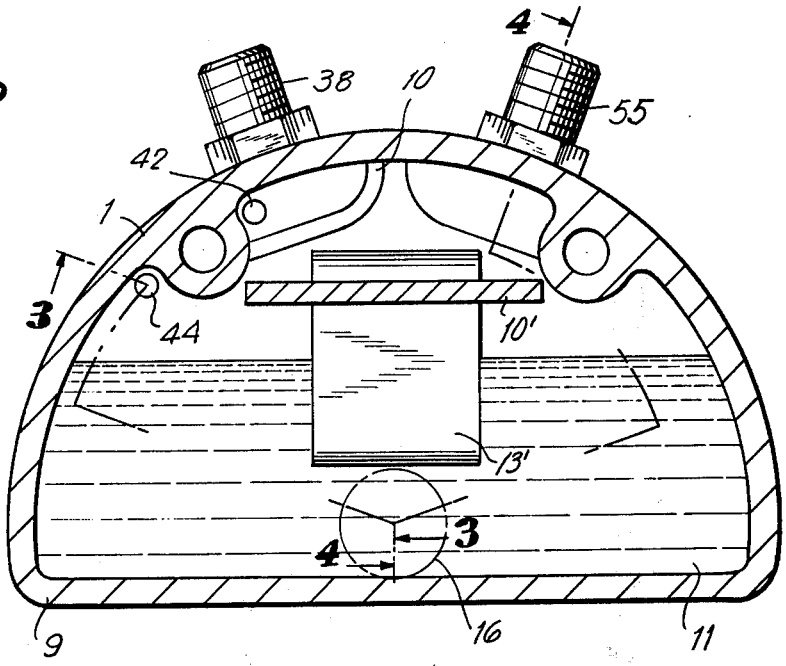
FIG. 2 is a sectional view taken on line 2—2 in FIG. 1 through the oil separating chamber.
Figure 3:
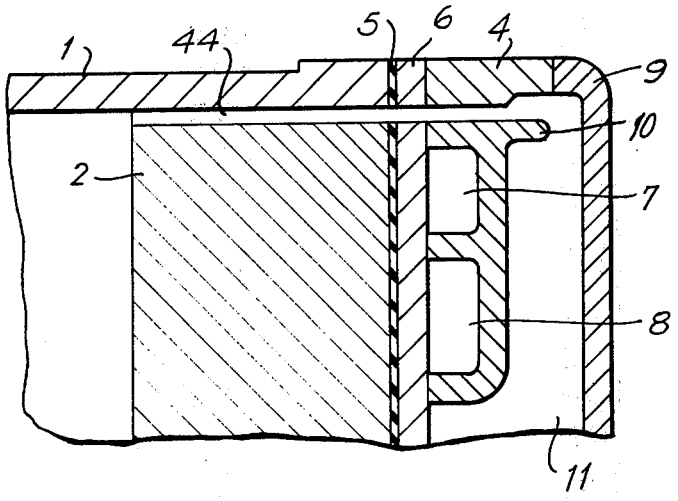
FIG. 3 is a section taken along line 3—3 in FIG. 2.

A duct 41 is formed in the cover body 14 and communicates with bearing 15. The duct 41 opens at one end into communication with the oil sump 39 and at the other end thereof with a longitudinal bore 42 provided in the casing 1. The bore 42 is in communication with suction port 12. A throughhole 43 is formed in rotor shaft 16 and rotor body 17 to connect the bottom of female screw thread 28 and the bushing 37. A communicating bore 44 is formed in the cylinder block 2 to connect the rotor chamber 3 and the upper portion of the oil reservoir 11 (FIGS. 2 and 3).

The operation of the compressor is as follows.

When the rotor driving shaft 16 is driven from an external drive source (not shown) the rocking plate 20 is rocked by the rotor body 17 to cause reciprocation of the pistons 23 through the universal joints 21' and connecting rods 21. The refrigerant gas is caused to flow into the suction chamber 8 from the suction nipple 38 through the suction port 12 and the vent chamber 13 during the suction strokes of the pistons 23, and then the refrigerant gas flows into the cylinder bores 22 via suction ports 50 by opening of suction valves 51. The refrigerant gas is discharged into the exhaust chamber 7 via exhaust ports 52 upon opening of exhaust valves 53 at the time of compression movement of the pistons 23 in the exhaust stroke. Stops 54 secured in chamber 7 serve to limit the degree of displacement of the exhaust valves. The construction of the valve plate 5 with the integral suction and exhaust valves is conventional. The discharged refrigerant gas is delivered forcedly to a refrigerating machine (not shown) such as an evaporator, condenser, or the like, from an exhaust nipple 55.

Figure 4:
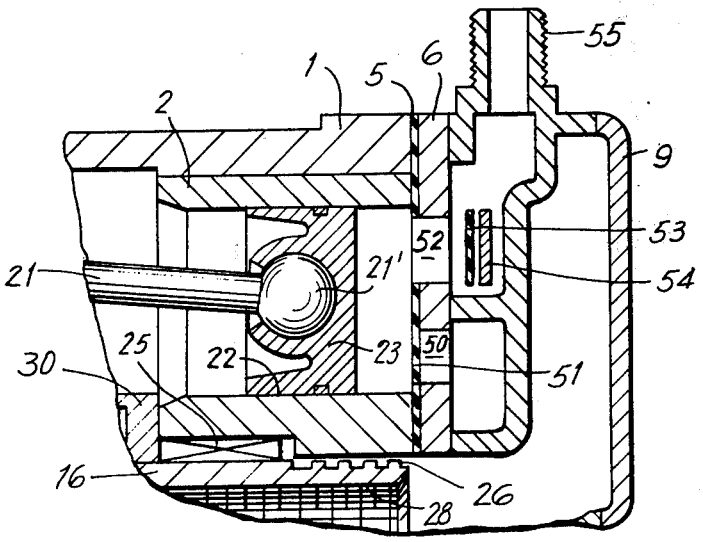
FIG. 4 is a section taken along line 4—4 in FIG. 2.

In FIG. 1 the piston is at its end of stroke position of discharge just before starting its suction stroke. Valves 51 and 53 are thus closed. When the pistion begins its suction stroke, valve 51 opens and refrigerant gas is sucked in via inlet nipple 38. FIG. 4 shows the piston in the exhaust stroke and therein suction valve 51 is closed against plate 6 and exhaust valve 53 is displaced to its open position by the pressure developed in cylinder 22.

In operation, some of the refrigerant gas leaks into the rotor chamber 3 through gaps between the pistons 23 and the walls of the cylinder bores 22. The lubricating oil within the oil sump 39 at the bottom of the rotor chamber 3 is agitated by means of the trunnion block 40 secured to the lower end of the inclined rocking plate 20 to cause atomization of the lubricant and the formation of atomized drops of lubricant. The thus atomized drops act to lubricate the thrust plates 32, 33, the bearings 19, the bearings 34, the thrust plate 36, the mechanical seal 24 etc. The atomized lubricant also flows together with the leaked refrigerant gas into the oil separating chamber 9 via the duct 41 and the bore 42 by the suction action of the pistons 23 at the time of retreat thereof in the suction stroke.

Also at the time of starting, the pressure within the rotor chamber 3 tends to drop suddenly, causing a boiling phenomenon in the lubricating oil, and the oil is atomized and tends to flow into the refrigerating cycle of the refrigerating machine.

However, by virtue of the construction according to the invention, the oil mixed with the refrigerant gas is separated from the gas by the separator baffle 10 due to the arrangement whereby the oil is cooled to a low temperature by the refrigerant gas and forms drops which fall into the oil reservoir 11. It is to be noted that the incoming refrigerant gas at port 12 mixes with the mixture of lubricant and leaked gas coming from bore 42 and after separation by baffle separator 10, the refrigerant gas flows in one passage i.e. vent chamber 13 to the suction chamber 8 for inlet into the cylinder bores 22 whereas the lubricant cooled by the incoming refrigerant gas and separated by separator baffle 10 flows in a second passage to the reservoir 11. The separated refrigerant gas and lubricant in the two passages are in heat exchange relation via partition 13'.

The lubricating oil within the oil reservoir 11 is forcedly delivered into the rotor chamber 3 (for return to sump 39) via bearing 25 by rotation of the male screw thread 26 on the outer surface at the end of rotor driving shaft 16 while the female screw thread 28 in the internal peripheral surface of the central bore of the shaft 16 delivers the oil through the throughhole 43 and bearings 19 to chamber 3 for return to the oil sump 39. The female screw thread 28 is relatively less effective in oil delivery capacity as compared to external male thread 26. Hence, the provision of the fixed center screw 16 with its external male thread supplements the forced delivery of oil from reservoir 11 through the bore in shaft 16 to the bushing 37 and bearings 19.

Furthermore, since the pressure in the rotor chamber 3 is relatively high as compared with that in the oil reservoir 11, the oil sometimes tends to flow reversely against the oil delivering force produced by the male screw thread 26 and the female screw thread 28. To obviate this, the communicating bore 44 in the cylinder block 2 establishes equilibrium between the pressure in the rotor chamber 3 and that in the oil reservoir 11.

Instead of the male screw thread 26 or the female screw thread 28, a positive oil delivering means could be employed, such as a gear pump or the like to satisfy the requirements of the invention, and with such oil delivery means, there will be no need to provide communicating bore 44, and the oil within the reservoir 11 may be delivered positively into the throughhole 43 through the central bore in the driving shaft 16. It also becomes possible to carry out lubrication by extending the central bore and connecting the same to bearing 15.

As seen from the above, the present invention is directed to a refrigeration compressor constructed such that in the compressor carrying out compressing action by reciprocating pistons through the rocking of the inclined rocking plate, the lubricating oil within the rotor chamber communicates at the suction side of the compressor with the separator means and the oil reservoir. Furthermore, the end of the rotor driving shaft communicates with said oil reservoir and carries oil delivery means so that lubricating oil within said oil reservoir is delivered forcedly into the rotor chamber so that lubricating oil which has flowed to the suction side in admixture with leaked refrigerant gas is separated by the separator means and flows into the oil reservoir. Furthermore, the lubricating oil within the oil reservoir is lowered in temperature and may be positively delivered forcedly into the rotor chamber by oil delivering means to prevent the lubricating oil from passing to the refrigeration machine with the refrigerant gas. This prevents degradation of the refrigerating capability. The lubricating oil flowing to the suction side is cooled by means of the incoming refrigerant gas and thereafter is returned back positively to the oil sump within the rotor chamber from the oil reservoir whereby the lubricating capability of the lubricating oil may be increased considerably.

What is claimed is:

1. In a compressor for a refrigerant gas wherein in a casing a drive shaft is coupled to a rotor which acts on an inclined rocking plate to effect rocking thereof and reciprocation of a piston in a cylinder bore to produce suction and exhaust strokes for refrigerant gas, a lubricant in a sump in the casing being atomized and mixing with refrigerant gas leaking past the piston, an improvement wherein the compressor has an inlet for the refrigerant gas, duct means for conveying the mixture of leaked refrigerant gas and lubricant from said casing under the action of the suction stroke of the piston, said duct means communicating with the inlet for refrigerant gas to mix the leaked refrigerant gas and lubricant with incoming refrigerant gas, separator means downstream of said inlet for separating the lubricant from the refrigerant gas, and lubricant delivery means on said drive shaft for returning the separated lubricant back to the sump, said separator means including a lubricant reservoir in communication with said lubricant delivery means.

2. An improvement as claimed in claim 1 wherein said separator means comprises a separator plate defining one passage for flow of separated lubricant and a second passage for flow of refrigerant gas to the cylinder bore.

3. An improvement as claimed in claim 2 wherein said passages are in heat exchange relation.

4. An improvement as claimed in claim 1 comprising baffle separators between said passages and said inlet for refrigerant gas.

5. An improvement as claimed in claim 1 wherein said lubricant delivery means comprises thread means on the drive shaft.

6. An improvement as claimed in claim 5 wherein the casing has a rotor chamber, the improvement further comprising means establishing pressure equilibrium between the rotor chamber and the lubricant reservoir.

7. An improvement as claimed in claim 1 wherein said duct means is provided in said casing.

8. An improvement as claimed in claim 1 wherein the compressor has a cylinder head with exhaust and inlet chambers, said separator means comprising a housing integral with said cylinder head and including a separator plate defining a first passage for flow of separated lubricant and a second passage for flow of refrigerant gas to the inlet chamber, said reservoir being in said housing for receiving lubricant from said first passage.

9. An improvement as claimed in claim 8 wherein said casing has an opening leading to said reservoir to enable lubricant therein to be returned to said sump by said lubricant delivery means.

* * * * *

UNITED STATES PATENT OFFICE
CERTIFICATE OF CORRECTION

Patent No. 4,019,342 Dated April 26, 1977

Inventor(s) Motomu Ohta

It is certified that error appears in the above-identified patent and that said Letters Patent are hereby corrected as shown below:

Change assignee to:--Central Automotive Industries, Ltd.--

Change Attorney, Agent or Firm to --Haseltine, Lake & Waters--

Signed and Sealed this

*Thirteenth* Day of *February 1979*

[SEAL]

*Attest:*

RUTH C. MASON
*Attesting Officer*

DONALD W. BANNER
*Commissioner of Patents and Trademarks*